United States Patent [19]

Meyst et al.

[11] Patent Number: 5,056,682

[45] Date of Patent: Oct. 15, 1991

[54] CONTAINER FOR FAN-FOLDED SHEETS

[75] Inventors: Richard P. Meyst, Valley Center; Joseph J. Manno, La Jolla; Jimmy J. Carlock, Vista; Ian F. Ayton, Palos Verdes Estates; Thomas K. Gregory, Carlsbad; Edward D. Suszynski, Vista, all of Calif.

[73] Assignee: Diatek Incorporated, San Diego, Calif.

[21] Appl. No.: 449,549

[22] Filed: Dec. 12, 1989

[51] Int. Cl.[5] ..... B65H 5/28

[52] U.S. Cl. ..... 221/25; 221/70; 221/185; 225/15; 225/32; 225/53; 225/54

[58] Field of Search ..... 221/25, 26, 70, 185, 221/312 R–312 C; 225/15, 16, 32, 53, 54; 206/38, 39.5, 39.6, 39.8, 408, 409, 390

[56] References Cited

U.S. PATENT DOCUMENTS 3,674,176 7/1972 Sagi ..... 221/26 X
4,032,004 6/1977 Coates ..... 206/39.6
4,700,835 10/1987 Rognsvoog, Jr. ..... 221/70 X

*Primary Examiner*—David H. Bollinger
*Attorney, Agent, or Firm*—Pretty, Schroeder, Brueggemann & Clark

[57] ABSTRACT

A container for carrying a uniform, fan-folded stack of plastic sheet assemblies and for allowing the assemblies to be conveniently dispensed, one at a time, with minimal risk that the stack will become jammed. The stack of assemblies is retained behind a constriction within an elongated chamber having a corresponding shape and slightly larger size. Pulling the forward-most assembly through a narrow channel and exit slot at the forward end of the container flexes a trailing assembly past the constriction, while the remaining assemblies remain retained behind the constriction. In addition, a shallow recess in a wall defining the narrow channel conformingly receives a plastic sheet assembly in position to be dispensed, with the recess' rear periphery inhibiting the assembly from being moved unintentionally back into the chamber.

27 Claims, 3 Drawing Sheets

CONTAINER FOR FAN-FOLDED SHEETS

BACKGROUND OF THE INVENTION

This invention related generally to containers for holding small flexible sheets and, more particularly, to containers that allow the sheets to be dispensed, one at a time, from a fan-folded stack.

Containers of this kind are particularly useful in the dispensing of hygienic plastic sheet assemblies for use in covering the elongated probe of a clinical thermometer. An example of such a protective cover assembly is shown and described in U.S. Pat. No. 4,911,559, entitled "Disposable Probe Cover Assembly for Medical Thermometer." The probe cover assemblies disclosed in that patent application each have three layers, including a plastic base layer with a central aperture, a stretchable plastic film spanning the aperture, and a protective paper layer. The three layers are laminated together to form a flat assembly having at least limited flexibility and having a generally square shape, with well-rounded corners, about ¾ to 1 inch across. The probe cover assemblies are connected together to form an elongated chain, and the individual covers are folded together in alternating directions to form a fan-folded stack.

There is a need for a container for carrying and hygienically protecting a fan-folded stack of flexible sheets such as the probe cover assemblies of the kind described and for allowing the sheets to be dispensed one at a time. The container should be configured so as to minimize the possibility of the fan-folded stack becoming jammed within it and so that the individual sheets can be effectively dispensed regardless of the number of sheets remaining within the apparatus. The container also should be configured such that the individual sheets being dispensed do not inadvertently retract back into the container. In addition, the container should be inexpensive to manufacture, yet be sufficiently strong to withstand normal handling without damaging its fragile contents. The present invention fulfills these needs.

SUMMARY OF THE INVENTION

The present invention is embodied in a container for hygienically carrying flat flexible sheets such as plastic probe cover assemblies and for allowing the sheets to be dispensed, one at a time, from a uniform fan-folded stack, with minimal risk that the stack will become jammed. The container includes an elongated storage chamber with a cross-sectional shape that corresponds generally with the shape of the individual sheets to be dispensed and a cross-sectional size the permits the stack of fan-folded sheets to slide along the chamber's longitudinal axis. An exit slot defined at one end of the elongated chamber is sized to allow the connected sheets to be dispensed end-wise therethrough, one at a time. In accordance with the invention, the container further includes retainer means spaced rearwardly of the slot for defining a constriction in the elongated chamber having a size slightly smaller than the sheets, so as to retain the stack of fan-folded sheets behind it. The sheets can then be individually dispensed by pulling the end-most sheet through the slot, which flexes a trailing sheet past the constriction, with the remaining sheets being retained by the constriction. The container is simple and inexpensive to construct, yet completely reliable in effectively dispensing the individual sheets.

More particularly, the elongated storage chamber is defined by four walls and the chamber has a generally square transverse cross-section, with well-rounded corners. The constriction is defined by ridges projecting inwardly from two opposing side walls, the ridges lying in a common plane, substantially perpendicular to the chamber's longitudinal axis. One of the four walls curves smoothly from the constriction to the exit slot. In use, pulling the end-most sheet through the slot in turn pulls a trailing sheet in the fan-folded stack past the constriction. The inwardly-projecting ridges in the side walls frictionally grip the sheet's side edges as the sheet slides past, to stabilize the sheet and prevent jamming. Eventually, the trailing edge of the sheet is pulled past the constriction and the process repeated with the next succeeding sheet.

In another, independent feature of the invention, the exit slot is defined by a channel formed by two spaced-apart, confronting walls (i.e., the chamber's top wall and bottom wall), one of the walls including a shallow recess having a rearward edge with a peripheral size and shape conforming with the rearward edge of the sheets being guided through the channel. The channel is configured such that a sheet being guided through it is urged into the shallow recess where its rearward edge abuts against the recess' rearward edge and thereby is inhibited from moving rearwardly toward the container. More particularly, the shallow recess has a progressively shallower depth with increasing distance from its rearward edge, such that the recess effectively is a ramp. In addition, the sheet's rearward edge is urged downwardly into abutment with the shallow recess' rearward edge by two upward projections near the recess' front end.

In another feature of the invention, the container is defined by two sections, each section being in the form of an elongated trough encircled by a rim, with a flange projecting outwardly from the rim. The two sections are attached to each other with their flanges in abutment. The two sections preferably are formed from a single sheet of plastic material and are initially pivotally connected together, at the end of the container opposite the slot.

Other features and advantages of the present invention should become apparent from the following description of the preferred embodiment, taken in conjunction with the accompanying drawings, which illustrate, by way of example, the principles of the invention.

DESCRIPTION OF THE PREFERRED EMBODIMENT

Figure 7:
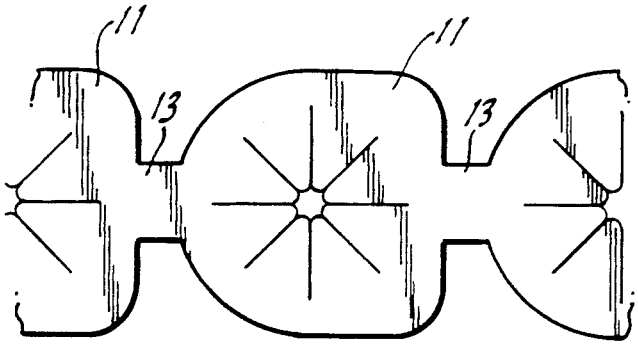
FIG. 7 is a plan view of several attached probe cover assemblies of the kind that can be arranged in a fan-folded stack and dispensed individually from the container of FIG. 1.

With reference now to the drawings, and particularly to FIGS. 1-5, there is shown a container for hygienically carrying a fan-folded stack of thin plastic probe cover assemblies 11 and for allowing the assemblies to be dispensed, one at a time. Each probe cover assembly (FIG. 7) includes three thin, laminated sheets having a generally square shape, with well-rounded corners, and a transverse dimension of about ¾ to 1 inch. The assemblies are connected together end-to-end by narrow strips 13 to form an elongated chain and are folded back on each other in an alternating fashion to produce a fan-folded stack adapted to be placed within the container. Thereafter, the probe cover assemblies can be selectively removed from the stack and individually dispensed.

The container includes a lower section 15 and an upper section 17 that are secured together to define an elongated chamber having a generally square cross-section with well-rounded corners for carrying the stack of fan-folded probe cover assemblies 11. A rear portion of the chamber has a generally square cross-section with rounded corners sized to be slightly greater in size than the stack of probe cover assemblies, to allow the stack to slide axially within it. An opposite, forward portion of the chamber has a uniform width, but progressively smaller height that terminates in a narrow exit slot 23 located at the container's forward end. The slot is sized to allow the probe cover assemblies to be individually dispensed end-wise therethrough.

The lower section 15 of the container is shaped like a trough, with a substantially uniform depth along its entire length. The section includes a bottom wall 25 and two opposed side walls 27 and 29. The rearward end of the lower section includes a rear wall 31, but the forward end is open. A flange 33 projects outwardly from the coplanar upper edges of the two side walls 27 and 29 and the rear wall 31.

The upper section 17 of the container includes a top wall 35, two side walls 37 and 39, and a rear wall 41, which cooperate to define a downwardly-concave portion at the section's rear and a downwardly-convex portion at the section's front. In particular, the top wall curves smoothly from a generally flat segment at the chamber's rear portion to a generally flat segment at the narrow exit slot 23. A flange 43 projects outwardly from coplanar edges of the side walls 37 and 39 and rear wall 41. This flange mates with the flange 33 of the lower section 15, to allow the two sections to be conveniently secured to each other.

Figure 5:
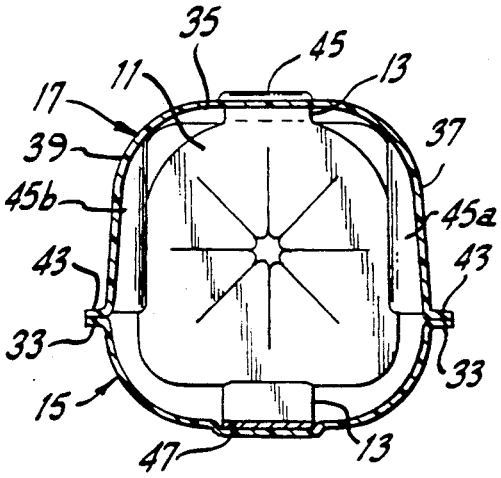
FIG. 5 is a sectional view of the container, taken in the direction of the arrows 5—5 in FIG. 2, with a probe cover assembly being shown retained behind ridges formed in the container's side walls.

In accordance with the invention, a reliable dispensing of individual probe cover assemblies 11 without jamming in the region of the narrow exit slot 23 is ensured by providing a constriction in the container's chamber 19 in the region where the top wall 35 begins to curve downwardly and the chamber's cross-sectional size begins to diminish. In particular, inwardly-projecting, coplanar ridges 45*a* and 45*b* are located in the respective side walls 37 and 39 of the upper section 17. As best shown in FIG. 5, these ridges cooperate to define an opening that is slightly narrower than the individual probe cover assemblies 11. The stack of assemblies is thereby retained behind the ridges.

In use, the probe cover assemblies 11 are dispensed through the exit slot 23 by pulling the end-most assembly outwardly. This drags the trailing assemblies behind it, including the particular assembly located at the constriction defined by the ridges 45*a* and 45*b*. In particular, and with reference to the sequential views of FIGS. 6(*a*)-6(*g*), pulling on the end-most assembly causes the assembly located immediately behind the ridges to flex such that its two side edges are pulled past the ridges. The ridges frictionally grip the flexed assembly as it is pulled past them, to stabilize the assembly within the container and thereby prevent the assembly from becoming jammed. The trailing edge of that assembly remains retained behind the ridges while the assembly pivots forwardly about that trailing edge. Eventually, the trailing edge, itself, is pulled past its ridges and the process is then repeated with the next succeeding assembly. It will be noted that the top wall initially curves downwardly with a curvature centered at a point generally aligned with the ridges.

Figure 3:
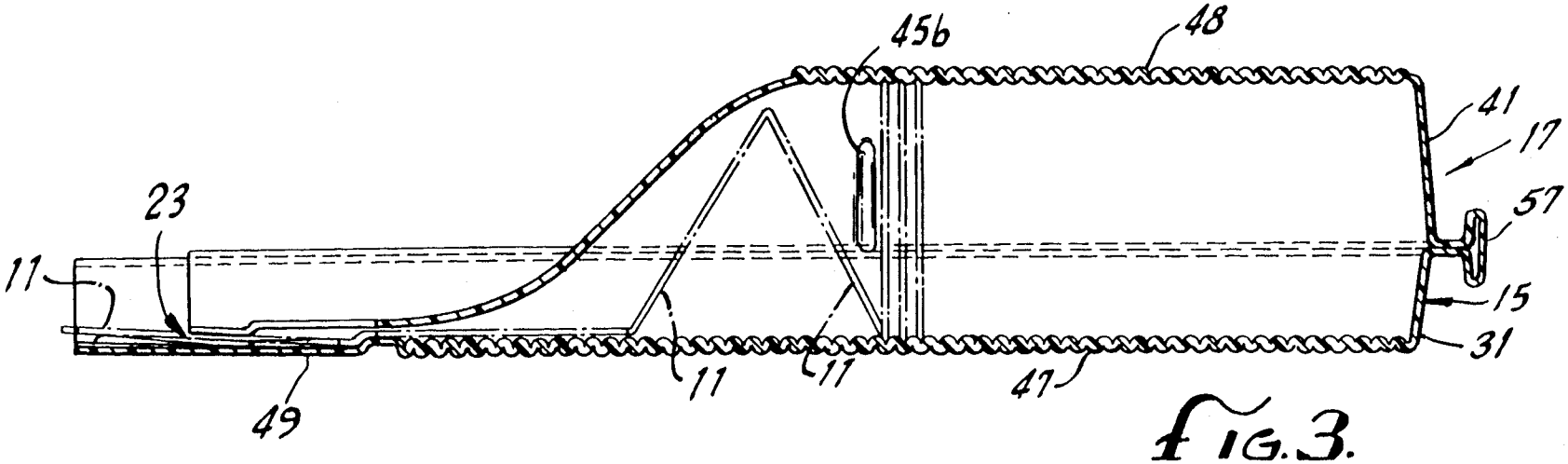
FIG. 3 is a side sectional view of the container, taken in the direction of the arrows 3—3 in FIG. 2.
Figure 6A:
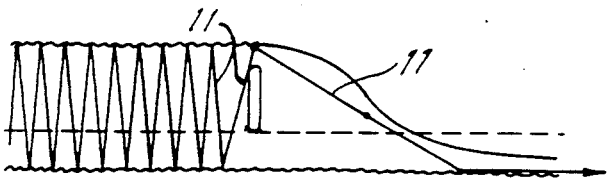
FIGS. 6(*a*)–6(*g*) are schematic views showing the sequential movement of the fan-folded stack of probe cover assemblies as two individual assemblies are successively dispensed.
Figure 6B:
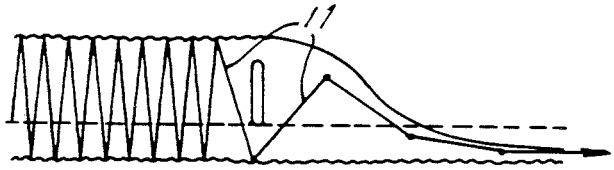
Figure 6C:
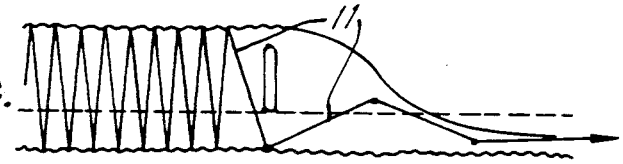
Figure 6D:
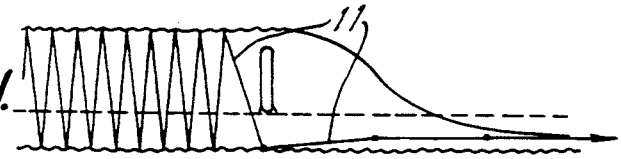
Figure 6E:
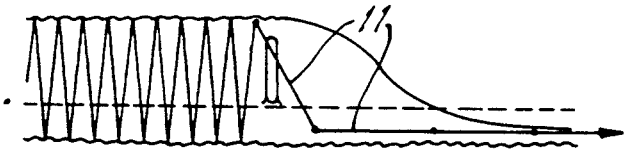
Figure 6F:
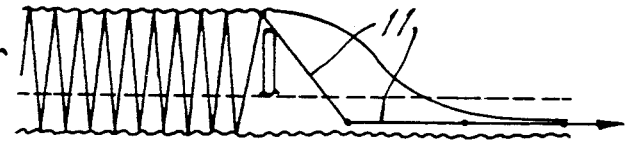
Figure 6G:
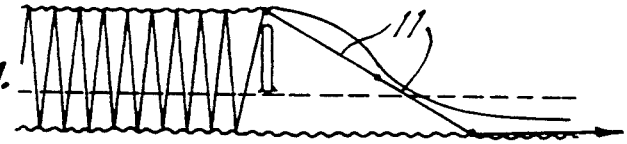

As best observed in FIG. 3, a uniform series of shallow ridges 47 is formed in the bottom wall 25 of the lower section 15, extending along substantially the entire length of the lower section, and a corresponding uniform series of shallow ridges 48 is formed in the top wall 35 of the upper section 17, extending only along the space behind the constricting ridges 45*a* and 45*b*. These two series of shallow ridges engage the narrow strips 13 interconnecting the successive probe cover assemblies 11 and thereby maintain the stack of fan-folded assemblies oriented generally vertically behind the constricting ridges. The shallow ridges 48 located in the portion of the bottom wall forward of the constricting ridges function to prevent an exposed stretchable plastic film in the assemblies from sticking to the bottom wall. The shallow ridges 48 also function to longitudinally stiffen the lower section.

Figure 2:
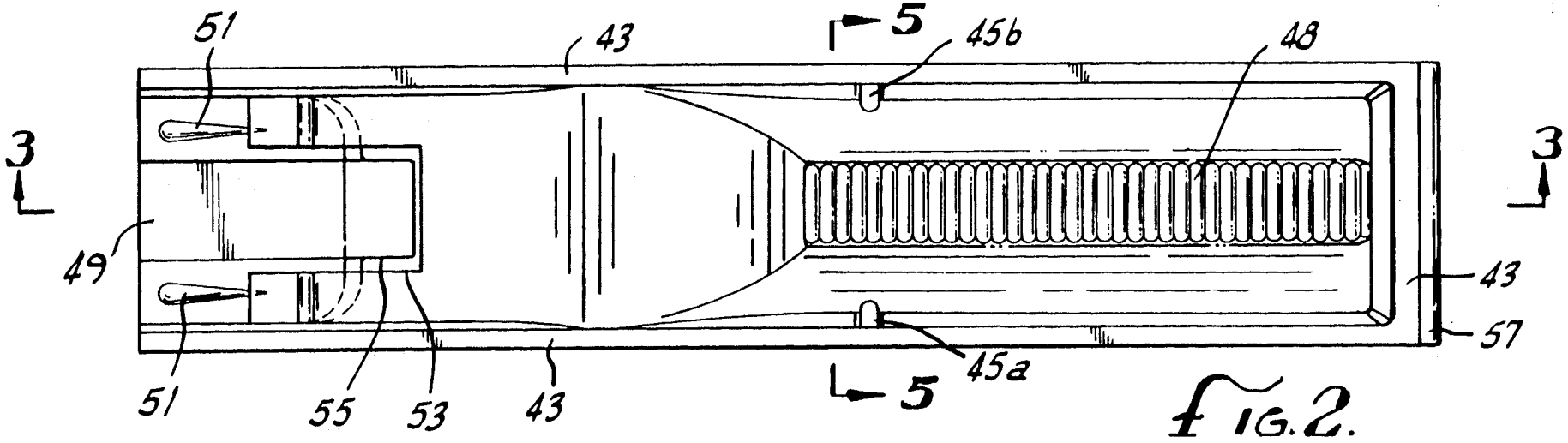
FIG. 2 is a top plan view of the container of FIG. 1, shown without the probe cover assemblies.

In another feature of the invention, and as best depicted in FIGS. 2 and 3, the forward end of the lower section's bottom wall 25 includes a shallow recess 49 having a shape corresponding generally with that of an individual probe cover assembly 11. The recess ramps upwardly toward the exit slot 23 at the end of the bottom wall, and a shallow vertical face 50 is thereby defined at the recess' rear periphery. The height of the vertical face is made to be slightly greater than the probe cover assembly's thickness, to ensure that the recess' natural radius beneath it does not push the trailing edge of any probe cover assembly located in this recess up and out of the recess. The assembly therefore will abut against this vertical face and be inhibited from being inadvertently moved rearwardly toward the container's chamber.

At the forward end of the shallow recess 49 are two upwardly-projecting bumps 51 that urge upwardly the forward end of any probe cover assembly 11 located in the recess. This further ensures that the assembly is not inadvertently moved rearwardly toward the chamber.

Figure 1:
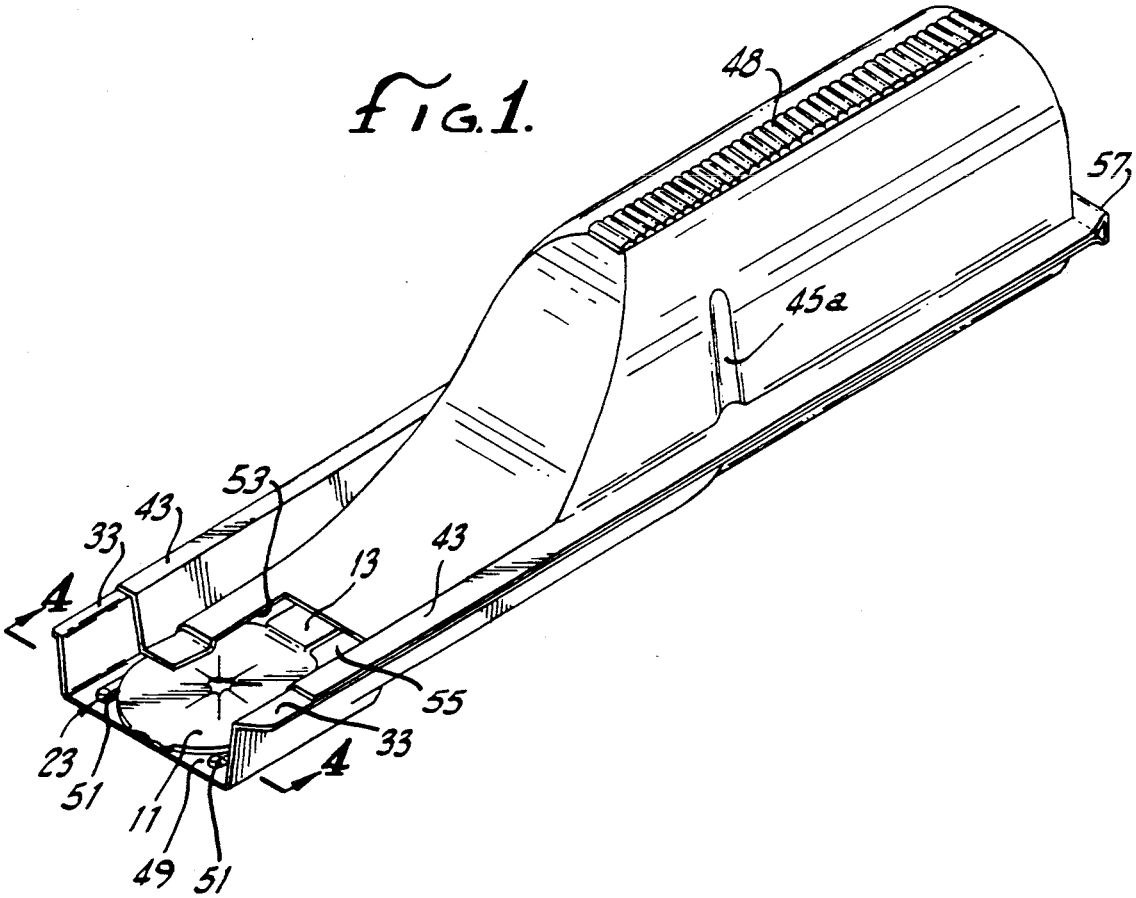
FIG. 1 is a front perspective view of a probe cover container embodying the invention, with individual plastic probe cover assemblies being dispensed, one at a time, through a slot in the container's forward end.
Figure 4:
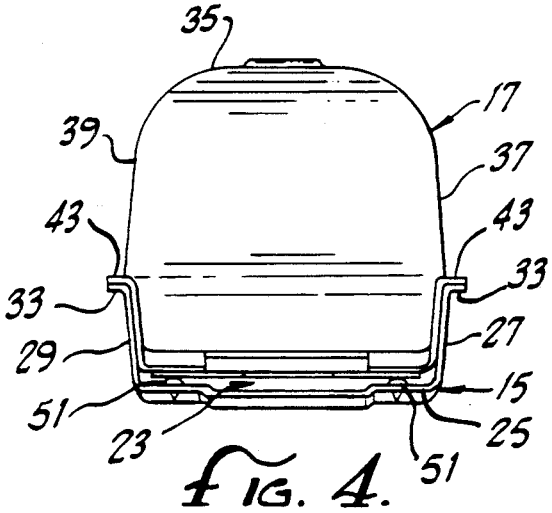
FIG. 4 is a front elevational view of the container of FIG. 1.

In another feature of the invention, best depicted in FIGS. 1 and 2, the top wall 35 of the container's upper section 17 includes a cutout 53 at its forward end, overlying the shallow recess 49 of the lower section 15. This cutout exposes a mid-portion of the upper surface of any probe cover assembly 11 located in the recess, allowing a U-shaped pawl (not shown) to engage the assembly's rearward edge, on opposite sides of the strip 13, and to urge it outwardly through the exit slot 23. Following the forcible advancement of each probe cover assembly out through the exit slot, the pawl retracts to a position where it can engage the rear periphery of the next succeeding assembly. A small rearward extension 55 of the shallow recess 49 allows the pawl to drop into a position where it can engage that next assembly's rear periphery.

As best shown in FIGS. 1 and 3, the dispenser's lower section 15 and upper section 17 are hinged together at the container's rear end by an integral hinge 57 and are formed from a single sheet of plastic material, e.g., polyvinyl chloride, preferably having a thickness of about 0.010–0.020 inches. The sheet can be formed into the specified shape using any of a number of conventional plastic forming techniques. In addition, the plastic material is preferably transparent, so that the number of stored probe cover assemblies 11 remaining to be dispensed can readily be determined.

The rear wall 31 and side walls 27 and 29 of the lower section 15 and rear wall 41 and side walls 37 and 39 of the upper section 17 are all formed with a draft of about 5 degrees. This facilitates a convenient removal of the sections from a standard molding apparatus. However, the constricting ridges 45*a* and 45*b* of the lower section do not include such a draft, such that their peaks are substantially parallel with each other.

It should be appreciated from the foregoing description that the present invention provides a container for carrying a fan-folded stack of plastic probe cover assemblies and for allowing the assemblies to be dispensed, one at a time, with minimal risk that the stack will become jammed. The stack of assemblies is retained behind a constriction within an elongated chamber having a corresponding shape and slightly larger size. Pulling the forward-most assembly through a narrow channel and exit slot at the container's forward end flexes a trailing assembly past the constriction, while the remaining assemblies remain retained behind the constriction. In addition, a shallow recess in a wall defining the narrow channel at the container's forward end conformingly receives a probe cover assembly in position to be dispensed, with the recess' rear periphery inhibiting the assembly from being moved inadvertently back into the chamber.

Although the invention has been described in detail with reference to the presently preferred embodiment, those of ordinary skill in the art will appreciate that various modifications can be made without departing from the invention. Accordingly, the invention is defined only by the following claims.

We claim:

1. A container for carrying a plurality of substantially flat, flexible sheets and for allowing the sheets to be dispensed, one at a time, wherein the sheets are of substantially the same shape and size and are connected together in a chain and arranged in a uniform, fan-folded stack, the container comprising:

means defining an elongated storage chamber with a longitudinal axis and a transverse cross-sectional shape that corresponds generally with the shape of the individual sheets and with a size that permits the stack of fan-folded sheets to slide along the chamber's longitudinal axis;

means located at a forward end of the elongated chamber for defining a slot sized to allow the connected sheets to be dispensed therethrough, one at a time; and retainer means located in the elongated chamber, rearwardly of the slot, for defining a constriction having a cross-sectional size slightly smaller than the sheets in a plane perpendicular to the chamber's longitudinal axis, so as to retain the stack of fan-folded sheets behind it, wherein the sheets can be individually dispensed by pulling the end sheet through the slot, which flexes a trailing sheet past the constriction, with the remaining sheets being retained behind the constriction.

2. A container as defined in claim 1, wherein the elongated storage chamber is defined by four walls and the chamber has a substantially rectangular transverse cross-section, with rounded corners.

3. A container as defined in claim 2, at least one of the four walls defining the elongated storage chamber curves smoothly from the constriction to the slot.

4. A container as defined in claim 2, wherein the constriction is defined by ridges projecting inwardly from two opposed walls, the ridges lying in a common plane, substantially perpendicular to the elongated storage chamber's longitudinal axis.

5. A container as defined in claim 1, wherein:

the means defining the elongated storage chamber includes two sections, each section including means defining an elongated trough encircled by a rim, with a flange projecting outwardly from the rim; and the two sections are attached to each other with their flanges in abutment.

6. A container as defined in claim 5, wherein:

the container is formed from a single sheet of plastic material formed into the specified shape; and the two sections of the means defining an elongated storage chamber are initially pivotally connected to each other at the end opposite the slot.

7. A container as defined in claim 1, wherein the means defining the slot includes:

a channel defined by two spaced-apart, confronting walls, one of the two walls including a shallow recess having a rear periphery with a size and shape conforming with the rear periphery of the individual sheets being guided through the channel; and means for urging a sheet located in the channel into the shallow recess, such that the sheet's rear periphery abuts against the shallow recess' rear periphery and is inhibited from moving rearwardly toward the chamber.

8. A container as defined in claim 7, wherein the means for urging includes two hemispherical projections projecting into the channel, the projections lying on opposite sides of the elongated storage chamber's longitudinal axis.

9. A container for carrying a plurality of plastic sheet assemblies and for allowing the assemblies to be dispensed, one at a time, wherein the assemblies are all of substantially the same shape and size and are connected together in a chain and arranged in a uniform, fan-folded stack, the container comprising:

means defining an elongated chamber having a longitudinal axis and including a rearward, stack-retaining section and a forward, dispensing section;

wherein the rearward, stack-retaining section of the chamber has a uniform transverse cross-sectional shape substantially the same as, but sized slightly larger than, the individual plastic sheet assemblies, such that the uniform, fan-folded stack of assemblies can slide axially within it;

wherein the forward, dispensing section of the chamber communicates with the storage chamber of the rearward section and has a uniformly-decreasing transverse cross-sectional size and terminates at an elongated slot through which the plastic sheet assemblies are individually dispensed;

wherein the means defining the elongated chamber further includes inwardly-projecting ridge means located between the stack-retaining section and the dispensing section, the ridge means defining a constriction sized slightly smaller than the individual plastic sheet assemblies in a plane perpendicular to the chamber's longitudinal axis, so as to retain the stack of fan-folded assemblies behind the ridge means, in the stack-retaining section;

and wherein the assemblies are dispensed individually through the elongated slot by pulling the end-most assembly through the slot, which in turn flexes a trailing assembly in the fan-folded stack past the ridge means constriction, after which that trailing assembly pivots about its trailing edge until the trailing edge itself is pulled past the ridge means constriction.

10. A container as defined in claim 9, wherein:

the rearward, stack-retaining section of the elongated chamber is defined by four walls; and the inwardly-projecting ridge means of the means defining the elongated chamber includes two segments lying in a common plane, substantially perpendicular to the chamber's longitudinal axis, and projecting inwardly from opposing walls of the rearward, stack-retaining section.

11. A container as defined in claim 9, wherein:

the means defining the elongated chamber is formed from a single sheet of plastic material formed into two halves that are pivotally attached to each other, each half being in the form of an elongated trough encircled by a rim, with a flange projecting outwardly from the rim; and the two halves of the means defining the elongated chamber are assembled by pivoting relative to each other to bring their respective flanges into abutment with each other.

12. A container as defined in claim 9, wherein the forward, dispensing section of the chamber is defined by:

two spaced-apart, confronting walls defining a channel, one of the two walls including a shallow recess with a rear periphery having a size and shape conforming with the rear periphery of the individual sheet assemblies being guided through the channel and slot; and two projections projecting into the channel and lying on opposite sides of the elongated chamber's longitudinal axis.

13. A container for carrying a plurality of flat, flexible sheets and for allowing the sheets to be dispensed, one at a time, wherein the sheets are substantially identical and are connected together end-to-end to form an elongated chain, the container comprising:

means defining a chamber for carrying a plurality of substantially identical, flat, flexible sheets connected end-to-end to form an elongated chain, each of the sheets having a predetermined peripheral shape; and means defining a narrow channel for guiding the chain of sheets from the chamber;

wherein the chamber and the narrow channel are configured such that pulling the end-most sheet forwardly through the channel pulls with it a trailing sheet from the chamber into the channel;

wherein the means defining a narrow channel includes two spaced-apart, confronting walls, one of the walls including a shallow recess having a rear periphery with a size and shape conforming with the rear periphery of the individual sheets being guided through the channel;

and wherein the means defining the narrow channel further includes means for urging a sheet located in the channel into the shallow recess, such that the sheet's rear periphery abuts against the recess' rear periphery and is inhibited from moving rearwardly into the chamber.

14. A container as defined in claim 13, wherein:

the flat sheets each include multiple layers, one of which is of limited flexibility, each sheet having a generally square periphery with rounded corners; and the shallow recess formed in one wall of the means defining the narrow channel has a corresponding square periphery with rounded corners.

15. A container as defined in claim 13, wherein the shallow recess formed in one wall of the means defining the narrow channel has a progressively shallower depth with increasing distance from its rear periphery end.

16. A container as defined in claim 13, wherein the means for urging includes two projections projecting into the channel.

17. A container as defined in claim 13, wherein:

the individual sheets in the elongated chain are folded back on each other in an alternating fashion to form a fan-folded stack; and the chamber is sized and shaped to loosely carry the fan-folded stack of sheets, such that the stack is slidable axially within it and unfolds as it enters the narrow channel.

18. A container as defined in claim 13, wherein the wall opposite the wall having the shallow recess is cut-out.

19. A container as defined in claim 13, wherein the means defining the chamber and the two walls defining the narrow channel are together formed from a single sheet of plastic material.

20. A container for carrying a plurality of substantially flat, flexible sheets and for allowing the sheets to be dispensed, one at a time, the sheets are all of the same size and substantially square shape, with rounded corners, and are connected together in a chain and arranged in a uniform, fan-folded stack, the container comprising:

four walls that define and elongated storage chamber with a longitudinal axis and a generally square transverse cross-section, with rounded corners, corresponding generally with the shape of the individual sheets and with a size that permits the stack of fan-folded sheets to slide along the chamber's longitudinal axis; and means located at a forward end of the elongated chamber for defining a narrow channel and an exit slot sized to allow the connected sheets to be dispensed therethrough, one at a time;

wherein two opposed walls of the four walls include ridges projecting inwardly in a common plane, substantially perpendicular to the elongated storage chamber's longitudinal axis, for defining a constriction having a cross-sectional shape corresponding generally with the shape of the individual sheets and a size slightly smaller than the sheets, so as to retain the stack of fan-folded sheets behind it, wherein the sheets can be individually dispensed by pulling the end sheet through the channel and exit slot, which flexes a trailing sheet past the constriction, with the remaining sheets being retained by the constriction;

wherein the means defining the narrow channel includes two spaced-apart confronting walls, one of the walls including a shallow recess with a rear periphery having a size and shape conforming with the rear periphery of the individual sheets being guided through the channel, the shallow recess further having a progressively shallower depth with increasing distance from its rear periphery;

and wherein the means defining a narrow channel further includes two projections projecting into the channel and urging a sheet located in the channel into the shallow recess, such that the sheet's rear periphery abuts against the recess' rear periphery and is inhibited from moving rearwardly into the elongated storage chamber.

21. A container for carrying a plurality of substantially flat, flexible sheets and for allowing the sheets to be dispensed, one at a time, wherein the sheets are of substantially the same shape and size and are connected together in a chain and arranged in a uniform, fan-folded stack, the container comprising:

means defining an elongated storage chamber with a longitudinal axis and a transverse cross-sectional shape that corresponds generally with the shape of the individual sheets and with a size that permits the stack of fan-folded sheets to slide along the chamber's longitudinal axis;

means located at a forward end of the elongated chamber for defining a slot sized to allow the connected sheets to be dispensed therethrough, one at a time; and retainer means located in the elongated chamber, rearwardly of the slot, for defining a constriction having a cross-sectional size slightly smaller than the sheets, so as to retain the stack of fan-folded sheets behind it, wherein the constriction is defined by ridges projecting inwardly from two opposed walls, the ridges lying in a common plane, substantially perpendicular to the elongated storage chamber's longitudinal axis, and wherein the sheets can be individually dispensed by pulling the end sheet through the slot, which flexes a trailing sheet past the constriction, with the remaining sheets being retained by the constriction.

22. A container for carrying a plurality of substantially flat, flexible sheets and for allowing the sheets to be dispensed, one at a time, wherein the sheets are of substantially the same shape and size and are connected together in a chain and arranged in a uniform, fan-folded stack, the container comprising:

means defining an elongated storage chamber with a longitudinal axis, the means defining the chamber including a bottom wall and a top wall;

means located at a forward end of the elongated storage chamber for defining a slot sized to allow the connected sheets to be dispensed therethrough, one at a time, in a plane substantially parallel with the chamber's longitudinal axis and immediately adjacent to the chamber's bottom wall;

retainer means located in the elongated chamber, rearwardly of the slot, for defining a constriction having a cross-sectional size slightly smaller than the sheets in a plane perpendicular to the chamber's longitudinal axis, so as to retain the stack of fan-folded sheets behind it, wherein the sheets can be individually dispensed by pulling the end sheet through the slot, which flexes a trailing sheet past the constriction, with the remaining sheets being retained behind the constriction; and means defining a flange projecting outwardly from opposite sides of the elongated storage chamber, between the chamber's bottom wall and top wall, the flange being substantially parallel along its entire length with the chamber's longitudinal axis.

23. A container as defined in claim 22, wherein the flange is located a substantially fixed distance from the bottom wall of the storage chamber and extends along substantially the entire length of the storage chamber.

24. A container as defined in claim 22, wherein:

the means defining the elongated chamber is formed from a single sheet of plastic material formed into two halves that are pivotally attached to each other; and the flange projecting from opposite sides of the chamber is formed by abutting flanges of the two halves.

25. A container for carrying a plurality of substantially flat, flexible sheets and for allowing the sheets to be dispensed, one at a time, wherein the sheets are of substantially the same shape and size and are connected together by narrow strips to form a chain and arranged in a uniform, fan-folded stack, the container comprising:

means defining an elongated storage chamber with a longitudinal axis, the means defining the chamber including a bottom wall and a top wall;

means located at a forward end of the elongated storage chamber for defining a slot sized to allow the connected sheets to be dispensed therethrough, one at a time, in a plane substantially parallel with the chamber's longitudinal axis and immediately adjacent to the chamber's bottom wall;

means defining a flange projecting outwardly from opposite sides of the elongated storage chamber, between the chamber's bottom wall and top wall, the flange being substantially parallel along its entire length with the chamber's longitudinal axis;

wherein the chamber's bottom wall and top wall both include a uniform series of shallow, transverse ridges, the series of ridges extending longitudinally along the lengths of the bottom wall and top wall, the ridges being sized to engage the narrow strips that connect together adjacent sheets in the stack of sheets and to maintain the sheets in an orientation substantially perpendicular to the chamber's longitudinal axis.

26. A container for carrying a plurality of substantially flat, flexible sheets and for allowing the sheets to be dispensed, one at a time, wherein the sheets are of substantially the same shape and size and are connected together by narrow strips to form a chain of sheets arranged in a uniform, fan-folded stack, the container comprising:

means defining an elongated storage chamber with a longitudinal axis, the means defining the chamber including a bottom wall and a top wall; and means located at a forward end of the elongated storage chamber for defining a slot sized to allow the connected sheets to be dispensed therethrough, one at a time;

wherein the chamber's bottom wall and top wall both include a uniform series of shallow, transverse ridges, the series of ridges extending longitudinally along the lengths of the bottom wall and top wall, the ridges being sized to engage the narrow strips that connect together adjacent sheets in the stack of sheets and to maintain the sheets in an orientation substantially perpendicular to the chamber's longitudinal axis.

27. A container as defined in claim 26, wherein:

the container further includes retainer means located in the elongated chamber, rearwardly of the slot, for defining a constriction having a cross-sectional size slightly smaller than the sheets in a plane perpendicular to the chamber's longitudinal axis, so as to retain the stack of fan-folded sheets behind it, wherein the sheets can be individually dispensed by pulling the end sheet through the slot, which flexes a trailing sheet past the constriction, with the remaining sheets being retained behind the constriction; and the top wall curves smoothly from the constriction to the slot.

* * * * *